US007399198B2

(12) United States Patent
Thalheimer et al.

(10) Patent No.: US 7,399,198 B2
(45) Date of Patent: Jul. 15, 2008

(54) DEVICE WITH SPEAKER AND RETRACTABLE CABLE UNIT

(75) Inventors: Richard J. Thalheimer, San Francisco, CA (US); Edward C. McKinney, Novato, CA (US); Tristan M. Christianson, San Francisco, CA (US); Andrew J. Parker, Novato, CA (US)

(73) Assignee: Sharper Image Corp., San Francisco, CA (US)

( * ) Notice: Subject to any disclaimer, the term of this patent is extended or adjusted under 35 U.S.C. 154(b) by 52 days.

(21) Appl. No.: 11/156,867

(22) Filed: Jun. 20, 2005

(65) Prior Publication Data

US 2006/0126883 A1 Jun. 15, 2006

Related U.S. Application Data

(60) Provisional application No. 60/663,942, filed on Mar. 21, 2005, provisional application No. 60/627,332, filed on Nov. 12, 2004, provisional application No. 60/611,051, filed on Sep. 16, 2004, provisional application No. 60/609,592, filed on Sep. 13, 2004.

(51) Int. Cl.
*H01R 13/72* (2006.01)

(52) U.S. Cl. ..... 439/501

(58) Field of Classification Search ..... 439/4, 439/501, 528, 929; 379/478; 381/385
See application file for complete search history.

(56) References Cited

U.S. PATENT DOCUMENTS

| | | | | |
|---|---|---|---|---|
| 3,798,389 | A | 3/1974 | Tokizaki | |
| 4,691,383 | A | 9/1987 | DeMars | |
| 4,942,617 | A | 7/1990 | Boylan | |
| 5,339,461 | A | 8/1994 | Luplow | |
| 5,481,607 | A * | 1/1996 | Hsiao | 379/438 |
| 5,641,067 | A | 6/1997 | Ellis | |
| 5,671,833 | A | 9/1997 | Edwards et al. | |
| 5,832,098 | A | 11/1998 | Chen | |
| 6,011,686 | A | 1/2000 | Grasso et al. | |
| 6,315,231 | B1 * | 11/2001 | Liaom | 242/378.1 |
| 6,327,507 | B1 | 12/2001 | Buchan | |
| 6,480,611 | B2 | 11/2002 | Hashimoto et al. | |
| 6,542,757 | B2 | 4/2003 | Bae | |
| 6,616,080 | B1 | 9/2003 | Edwards et al. | |
| 6,712,304 | B1 | 3/2004 | Taylor | |
| 6,803,525 | B1 | 10/2004 | Liao | |
| 6,834,820 | B2 | 12/2004 | Wei | |
| 6,847,724 | B1 | 1/2005 | Weng et al. | |
| 7,175,450 | B1 * | 2/2007 | Lung | 439/155 |

OTHER PUBLICATIONS

The Apple Store (U.S.) web page for Bose SoundDock Digital System advertisement http://store.apple.com/1-800-MY-APPLE/WebObjects/AppleStore.woa/72007/wo/z47vNYorWZuM2hBGKW11GWpNutn/2.0.0.11.1.0.6.9.3.19.0.1.0.1.1.0.1.0.3, printed on Jun. 20, 2005.

(Continued)

*Primary Examiner*—Phuong K Dinh
(74) *Attorney, Agent, or Firm*—Bell, Boyd & Lloyd LLP

(57) ABSTRACT

A device with speakers can include a cable unit with a connection plug connectable to a portable media unit. The cable can provide an audio signal from the portable media unit to a speaker of the device. The cable be attached to the portable media unit. A removable module for housing the plug and cable is also provided.

22 Claims, 12 Drawing Sheets

OTHER PUBLICATIONS

The Apple Store (U.S.) web page for Altec Lansing IM3c advertisement http://store.apple.com/1-800-MY-APPLE/WebObjects/AppleStore.woa/72007/wo/z47vNYorWZuM2hBGKW11GWpNutn/2.0.0.11.1.0.6.9.3.19.0.1.1.1.1.0.1.0.3, printed on Jun. 20 2005.

* cited by examiner

DEVICE WITH SPEAKER AND RETRACTABLE CABLE UNIT

CLAIM OF PRIORITY

This application claims priority to U.S. Provisional Application No. 60/609,592 entitled "Device with Speaker and Retractable Cable Unit", filed Sep. 13, 2004; U.S. Provisional Application No. 60/627,332 entitled "Chair with Digital Media Mount", filed Nov. 12, 2004 and U.S. Provisional Application No. 60/611,051 entitled "Chair with Retractable Cable Unit", filed Sep. 16, 2004; and U.S. Provisional Application No. 60/663,942, filed Mar. 21, 2005 each of which is incorporated herein by reference in its entirety.

BACKGROUND OF THE INVENTION

Portable music units such as MP3 players and other digital and/or analog music players have become quite popular in recent years. Some portable music players use a hard disk or flash memory to store music files, such as MP3s. Such portable music players use these music files to create an audio signal. The audio signal created by the portable music unit is typically sent to an output such as, for example, a headphone jack on the portable music unit. Headphones or an external speaker can be plugged into the audio output jack so that the user can listen to the music. Some portable music units also have proprietary connections for use in transferring music files and signals as well as providing power to the portable music unit.

BRIEF DESCRIPTION OF THE DRAWINGS

FIG. 2A shows the cable in a retracted position and FIG. 2B shows the cable in an extended position.

DETAILED DESCRIPTION OF THE INVENTION

Embodiments of the present invention concern a cable module attached to the housing of a device including at least one speaker. The cable module can include a connection cable with a plug connectable to a portable music unit to provide an audio signal to the at least one speaker. The cable can be retractable or non-retractable. In an embodiment utilizing a retractable cable, the cable can be moveable between an extended position and a retracted position.

The cable unit allows the user to extend the cable from the device to the portable music unit. The user need not plug the cable into the device each time a connection is to be made, nor need there be any loose wires connected to the back of the device. In an embodiment the cable is retractable. The retractable cable unit can use a tensioning spring to wind the cable in from the extended position to the retracted position. The housing of the device can also include a mount for the portable music unit.

Further embodiments of the invention include a portable music player mount that is adapted to be removably or permanently positioned on a device with a speaker, and wherein the mount incorporates a cable unit with a plug connectable to a portable music unit such as a portable music player. Still further embodiments of the invention include a cable module that can be selectable and removably mounted into a port or recess of a housing of a device with at least one speaker. Insertion of the retractable or non-retractable cable module can simultaneously make electrical contact between contacts on the outside of the retractable cable module and the port or recess of the housing.

As depicted on FIGS. 1A, 1B, 2A and 2B, one embodiment of the present invention is a device comprising a housing, at least one speaker within the housing and a retractable cable module attached to the housing. The retractable cable module can include a connection cable with a plug connectable to a portable music unit to provide an audio signal to the at least one speaker. The cable is movable between an extended position and a retracted position. Preferably, a portion of the cable is extended outside of the retractable cable unit in the extended position, but, preferably, not in the retracted position. In one embodiment, the retractable cable module is positioned within the housing. In one embodiment, the retractable cable module is permanently affixed to or included in the housing with the speaker. In another embodiment the retractable cable unit is removably positionable on or in the housing with the speaker. In yet another embodiment the cable is a predefined length and is not retractable as shown for example in FIG. 8.

Figure 1A:
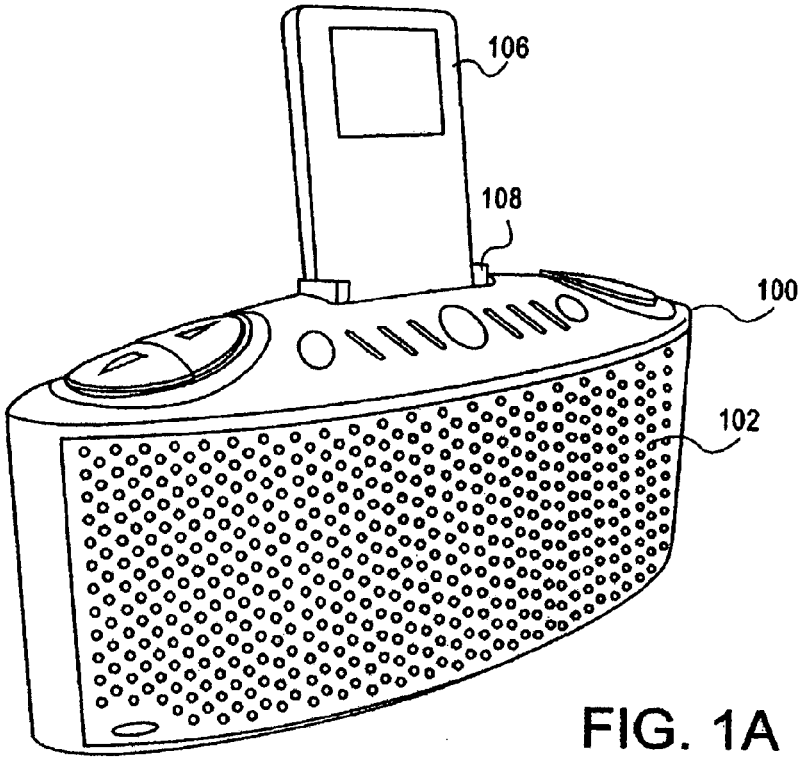
FIGS. 1A and 1B are perspective views of a device with a speaker of one embodiment of the present invention.
Figure 1B:
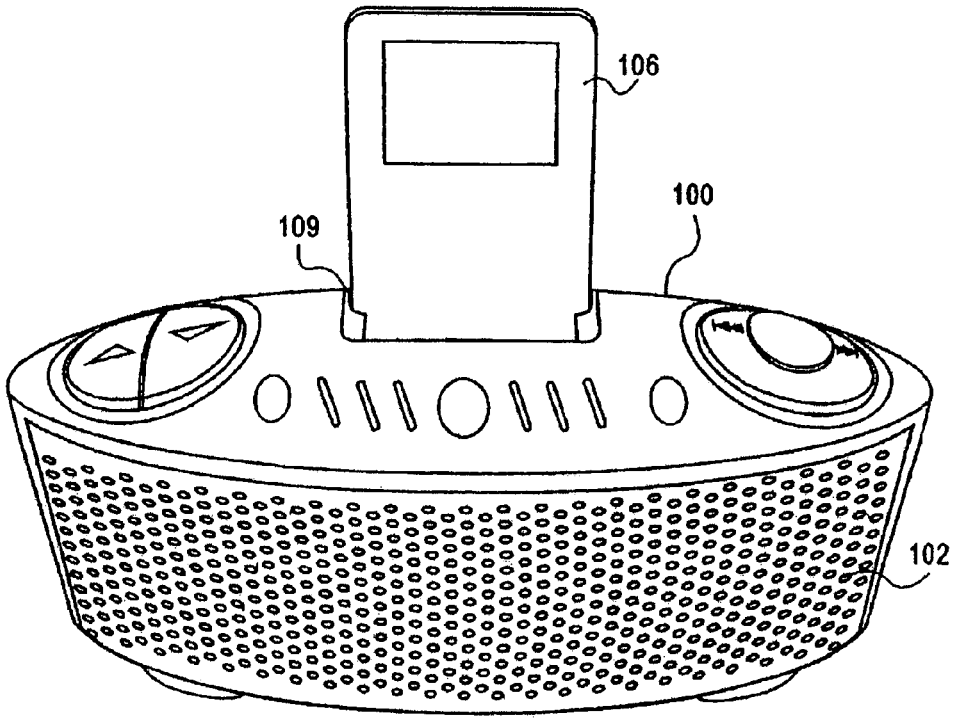

FIGS. 1A and 1B illustrate an embodiment of a device 100 including at least one speaker 102. Embodiments of devices with speakers can include tape players, CD players, stand-alone speakers, radios, sound generators, audio-visual systems and the like. FIGS. 1A and 1B illustrate an embodiment in which a portable music unit 106 can be positioned on the device 100 in a holder 108. The portable music unit 106 can be any portable unit including an MP3 player, a radio, a Compact Disk (CD) player or a video player, such as a portable digital video player that stores digital video files (an audio component of the video signal can be played through the speakers 102). In this embodiment, the holder includes a well or recess 109 which is adapted to receive the bottom of the portable music unit as well as backrest 113 (FIG. 2A) against which the portable music player can lean against. A multimedia signal can be an audio, a visual or a combined signal. In an embodiment the holder is adapted to receive the bottom of the portable music unit, and creates sufficient support for the portable music unit, such that a backrest and/or well or recess is not required to fully support the portable music unit.

Figure 2A:
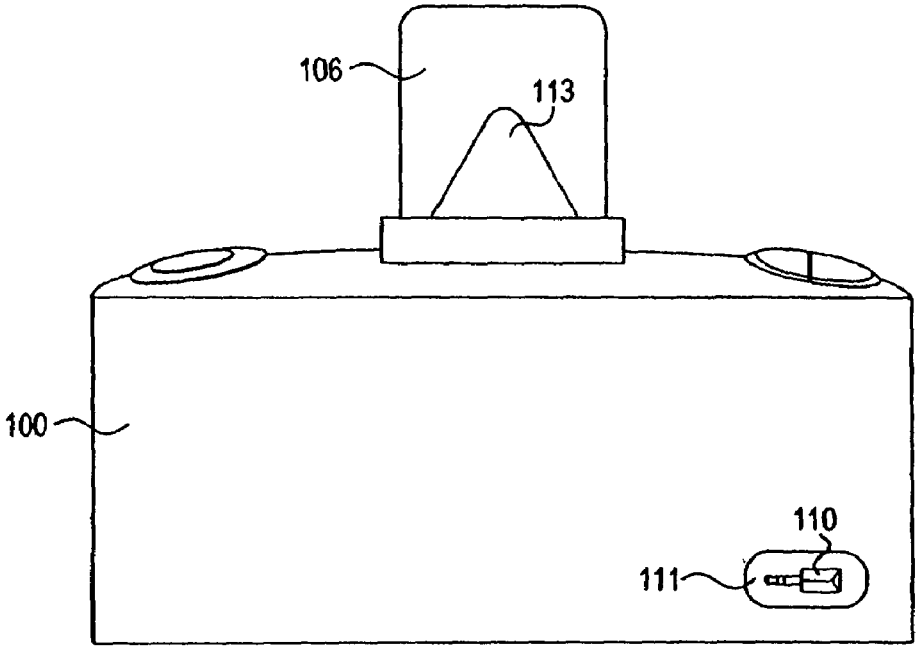
FIGS. 2A and 2B illustrate a device with a retractable cable module of one embodiment of the present invention.
Figure 2B:
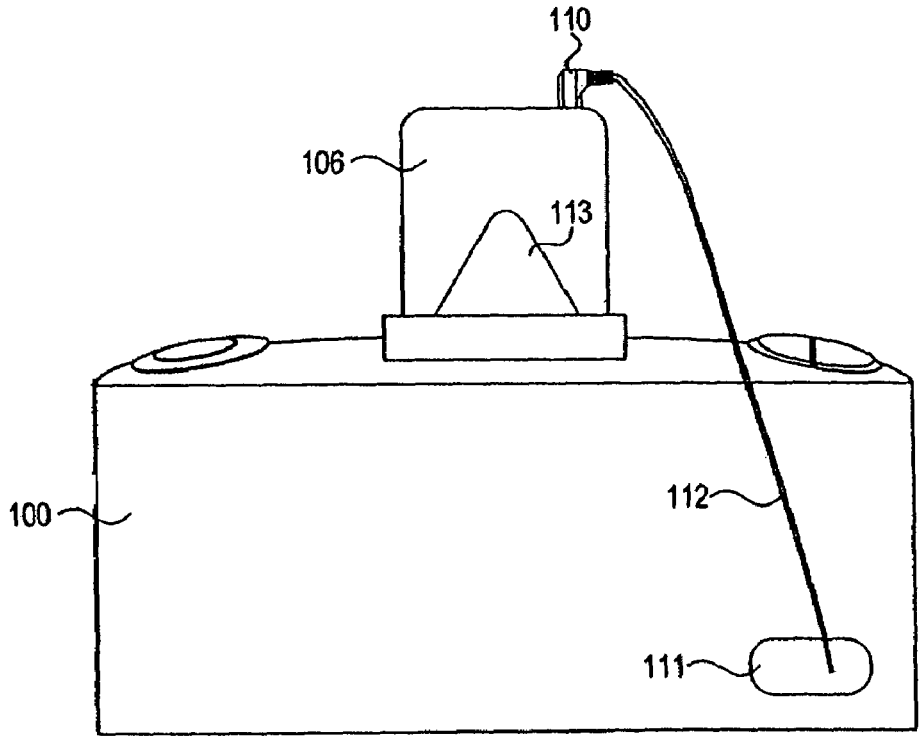

FIGS. 2A and 2B illustrates an embodiment wherein a retractable cable module is employed, and further illustrates the movement of the cable from the retracted position to the extended position. As shown in FIG. 2A, in the retracted position, the plug 110 can be positioned adjacent to the housing of the device 100. The plug 110 can be positioned in a recess 111. As shown in FIG. 2B, the cable 112 can be pulled out so that the plug 110 can be connected to the portable music unit 106. In one embodiment, the retractable cable module can allow for the cable to be extended to a variety of lengths so there is effectively a range of extended positions. The cable 112 can transfer an audio signal which can be any type of analog or digital audio signal or file. In one embodiment, the plug 110 is a stereo music plug, such as a 3.5 mm stereo plug. In some embodiments, the plug and cable may also transfer power to the portable music player 106.

In one embodiment, the device 100 auto-detects when the plug 110 is connected to the portable music unit 106. This can be done by detecting when the plug 110 is placed within a jack of the portable music unit 106, by detecting a signal from the portable music unit 106, or by some other means. When the device 100 detects that the plug is connected to the portable music unit 106, the device can interrupt any other audio sources of the device 110. Alternately, the device can wait until the audio signal is detected from the portable music unit to interrupt any other audio source. The retractable cable module can act as an auxiliary audio input for the device.

Figure 3:
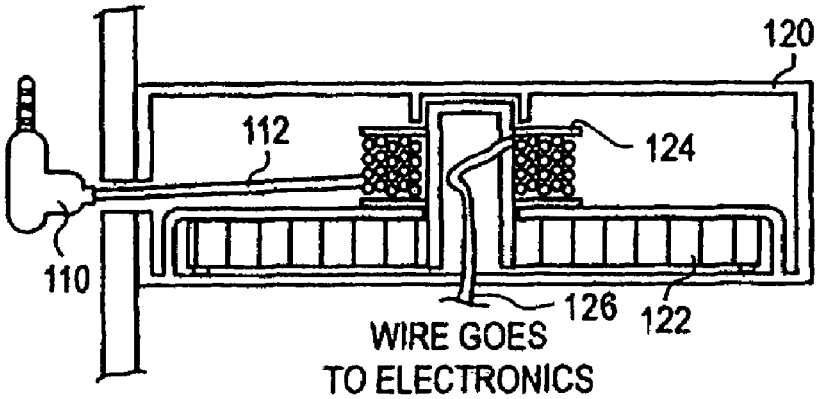
FIG. 3 is a cross-sectional diagram of an exemplary retractable cable module of one embodiment of the present invention.

FIG. 3 illustrates an exemplary retractable cable unit of one embodiment of the present invention. People skilled in the art will understand that alternate retractable cable unit designs can be used. In the example of FIG. 3, the retractable cable unit includes a coiled tensioning spring 122, such as a coiled tensioning spring. The tensioning spring 122 can be used to wind up the cable on the spool 124. The other end 126 of the cable can be permanently attached to the electronics of the device or can have a second plug to plug into a jack of the device. As the wire 112 is pulled from the retractable cable module 120, the tensioning spring 122 stores energy. The tensioning spring 122 can use this stored energy to pull in the cable from the extended position to the retracted position.

The retractable cable unit 120 can include a ratchet (not shown) for holding the cable 112 in an extended position. The ratchet can be operably connected to the spool 124 to hold the spool and thus the cable in the extended position. When the ratchet is disengaged, the cable can then be pulled back into the retractable cable module under the tension provided by the tensioning spring 122. The ratchet can be disengaged using an external button or by slightly pulling on the cable.

Figure 4:
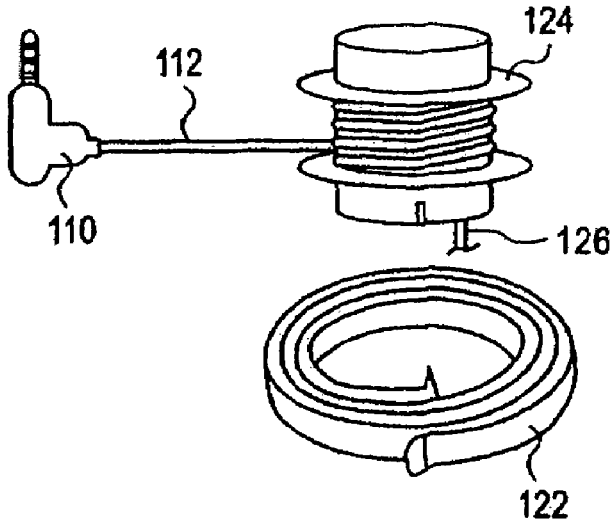
FIG. 4 is an exploded diagram of components of the retractable cable module of one embodiment of the present invention.

FIG. 4 illustrates an exploded view of components of the retractable module of one embodiment, illustrating the tensioning spring 122 and the spool 124. The tensioning spring 122 can be a metal ribbon coil that is connected to the spool 124.

Figure 5:
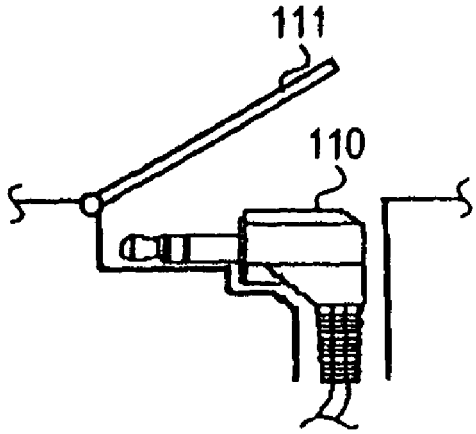
FIG. 5 is a diagram that illustrates an embodiment where the plug fits against a surface shaped to hold the plug.

FIG. 5 illustrates an embodiment where the plug 110 fits against a surface shaped to hold the plug 110. A door 111 can be used to provide access to the plug 110. The door 111 can tilt, pivot, slide or open in some other fashion. A mechanism can be used such that when the plug or door is pushed on, the plug is released freeing some of cable so that the cable can be easily removed. Such a mechanism can include a latch with a spring.

Figure 6A:
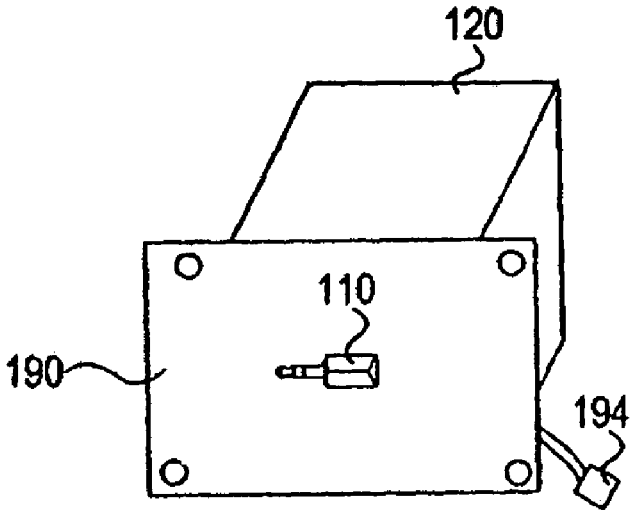
FIG. 6A is a perspective view of a retractable cable module of one embodiment.

In an embodiment employing the retractable cable, the retractable cable module 120 can be removable from the device. FIG. 6A illustrates an example in which the retractable cable module is a removable module 190. In this example, the module 190 can be screwed into the housing of the device. In one embodiment, a second plug 194 of the module can connect to the device. After the module 190 is partially removed from the device, the plug 194 can be unplugged from the device. This can allow for easy service or replacement of the module 190. In one embodiment, the housing can have a door to allow access to the retractable cable unit.

Figure 6B:
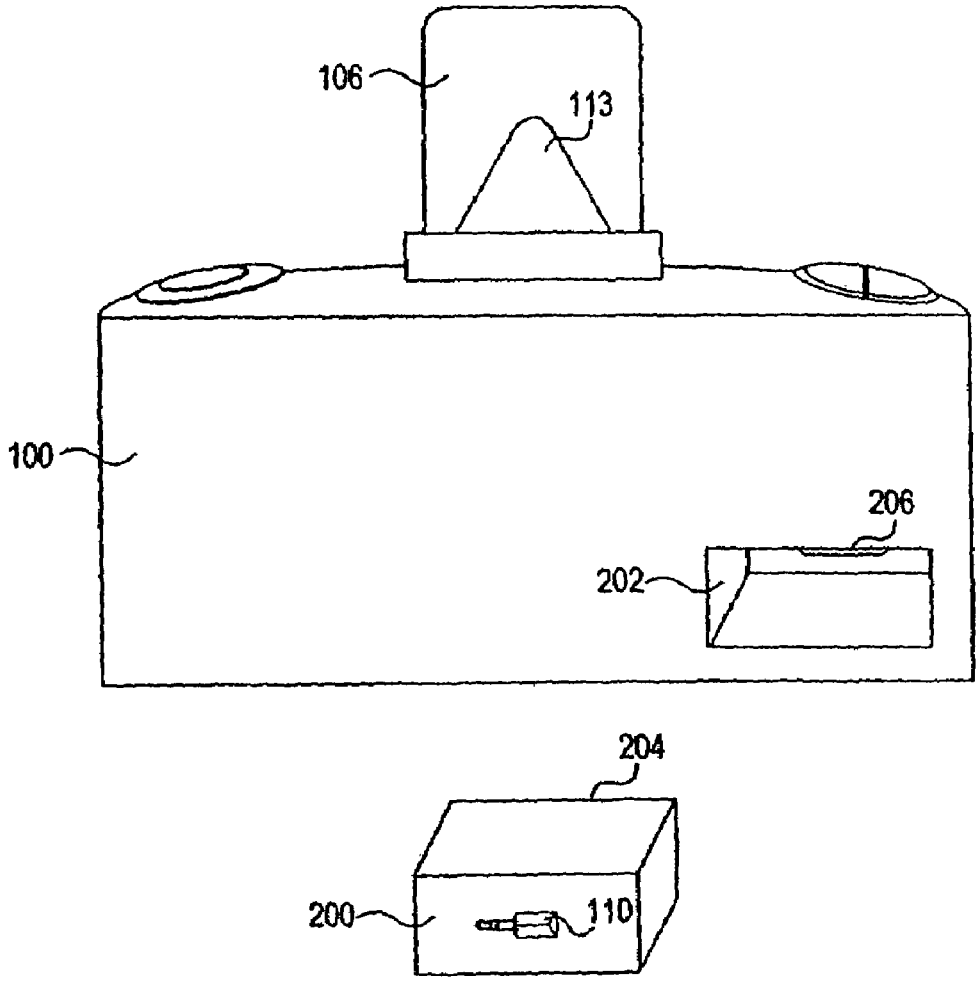
FIG. 6B is a diagram of a retractable cable module that fits in a slot of a device with a speaker.

As shown in FIG. 6B, a module 200 with the retractable cable can fit into a slot 202 in the housing of the device 100. The module 200 can click into place or be held in place by friction. The module 200 can have a connector 204 on the module housing to operably connect to a connector 206 on the device 100. The connectors 204 and 206 can be used to transfer the audio signal from the module 200 into the device 100. The connectors can also be used to transfer power from the device to the portable music unit.

The device can also use other modules that fit into the same slot 202 of the device 100. For example, a female input module or other auxiliary input connection port module can be used interchangeably with the retractable cable module. The auxiliary input connection can be of the type found on the back of a conventional stereo sound system, male or female can be a connection such as that used by cartridges in video game counsels, can be a connection such as that used with conventional memory cards, can be a connection such as that used to connect peripherals to a computer or laptop, or the like.

Figure 7:
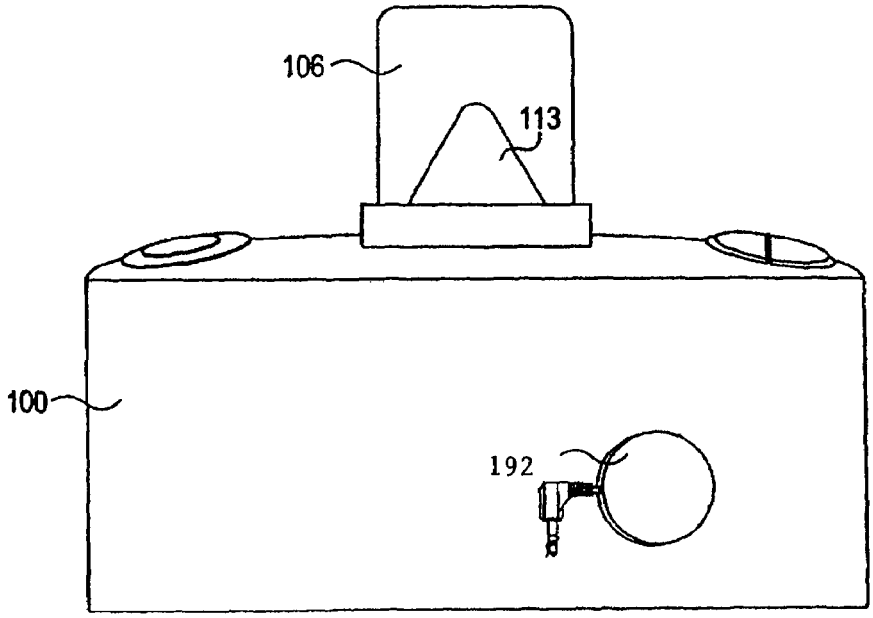
FIG. 7 illustrates a retractable cable module attached to the outside of the housing of a device with a speaker.

The retractable cable unit can be partially or completely within the housing as shown in FIG. 3. Alternately, as shown in FIG. 7, the retractable cable module 192 can be attached to the outside of the device 100. The retractable cable module 192 can be attached with screws, bolts, sticky pads or adhesive to the outside of the housing. The retractable cable unit can use a second plug to, for example, plug into an auxiliary input of the device or make some other operable connection to the device in a manner similar to that described above relating to the auxiliary input connection. In another embodiment, the retractable cable module can be removably or permanently inserted into a port or recess of the housing of the device with the speaker.

Figure 8:
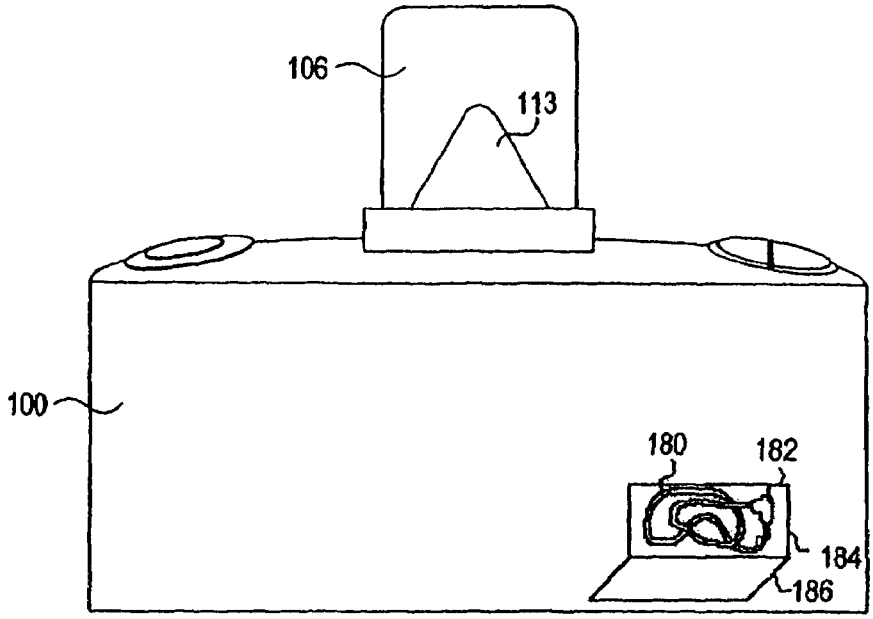
FIG. 8 illustrates a device with a speaker having a recess for storing a cable for connection to a portable music unit.

In one embodiment, other ways of storing the cable in the housing of the device can be used. FIG. 8 illustrates one embodiment in which the device 100 includes a recess 184 for storing a non-retractable cable 180 with the plug 182 within the housing. In one embodiment, the housing can include a door 186 that closes over the recess 184. The plug 182 can be removed from the housing and connected to the portable music unit 106. The cable 180 and plug 182 can be returned to the housing after use.

One embodiment of the present invention is a holder for a portable music unit comprising a holder body to receive a portable music unit and a cable module within the holder body. The cable unit can be retractable or non-retractable and can include a connection cable to transfer an audio signal. In an embodiment employing a retractable cable, the cable is movable between an extended position and a retracted position.

Figure 9B:
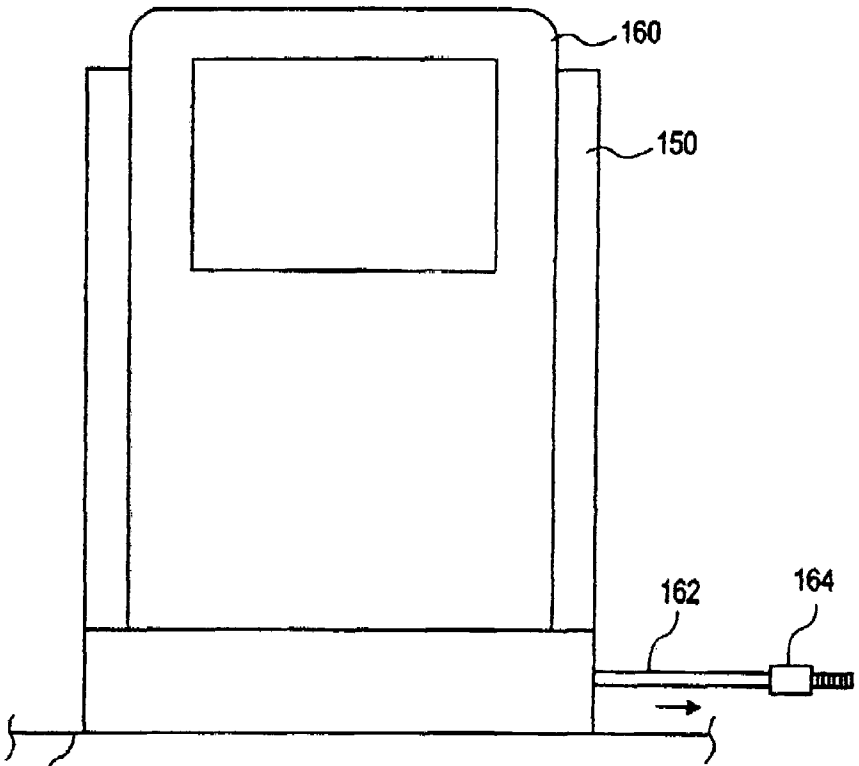
FIGS. 9A-9C illustrate holders for a portable music unit including a retractable cable module.
Figure 9A:
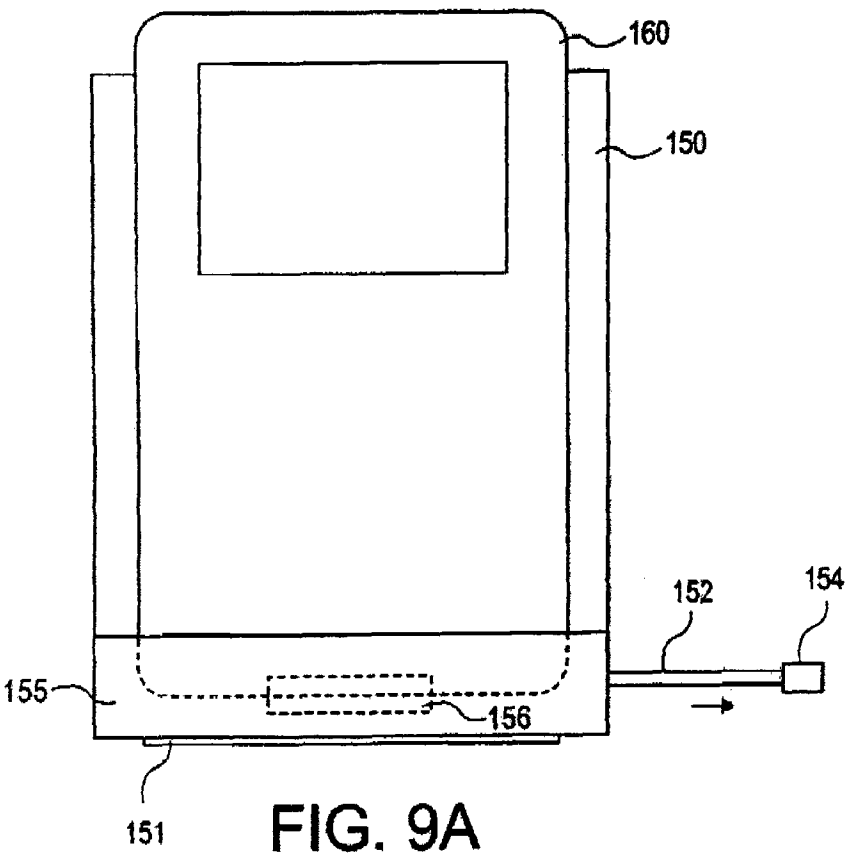
Figure 9C:
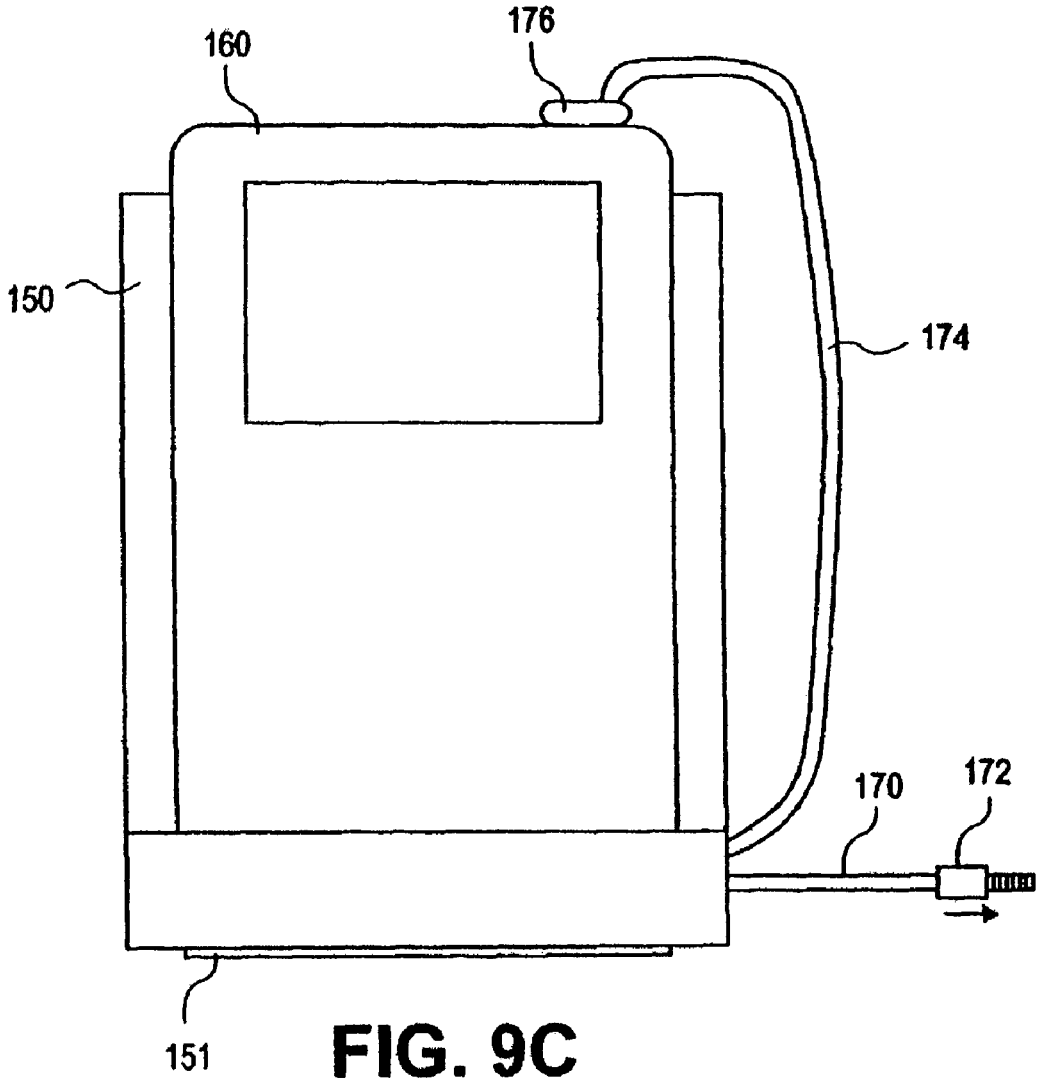

FIGS. 9A-9C illustrate an embodiment in which a holder 150 for a portable musical unit 160 includes a holder body to receive the portable music unit 160. In the example of FIG. 9A, the holder 150 has a connector 156 to receive a connection on the bottom of the portable music unit 160. The connector can include connections for audio signal transfer and power. The cable module 152 can be retractable or non-retractable and can be used to transfer both the audio signal and the power from a device with a speaker, to the holder and thereby to the portable music unit. The plug 154 from the cable module 152 can then be connected to a device with speakers to play music from the portable music unit 160 while providing power and recharging the portable musical unit 160. In the example of FIG. 9A, a sticky pad 151 can be used to connect the holder 150 to a device. Other mechanisms including bolts and/or other fastening devices can be used to secure the holder 150 to, for example, a housing of a device with a speaker. Alternatively, the holder can be a part of the device, thereby eliminating the need to affix the holder to the device. Further it is to be understood that the base 155 can be weighted to allow the holder 150 to stand upright on a surface without the need to secure the holder 150 to the surface with a sticky pad, bolts or any other mechanism. In this case a sticky pad or other securing mechanism of the holder 150 could be removed as desired. The examples shown in FIGS. 9A-9C show a backrest on the holder for the portable music unit 160. The backrest is not required. The cable module can be positioned in a base 155 of the holder. The cable module can be removable from the holder for servicing. In one embodiment, a retractable cable is employed wherein in the retracted position, when the plug is pushed on, a mechanism releases some of the cable so that the cable can be easily removed. The retraction mechanism depicted in FIG. 3 can be used in the embodiment of FIG. 9A to store and selectively deploy the cable 152. In one embodiment, the connection cable is used for connecting to a device with a speaker.

As shown in FIG. 9B, in one embodiment, the holder 150 can be part of device 166 with a speaker. In this embodiment, the cable unit can provide a stereo cable 162 and plug 164 for connecting to a jack on the top of the portable music unit 160. The device 166 can include speakers to play music from the portable music unit. The cable can be retractable or non-retractable.

FIG. 9C illustrates an embodiment in which the holder 150 has a second connection cable 174. The second connection cable 174 can be connected to the speaker output jack of the portable music unit 160. The signal can then go through the retractable cable unit 150 to plug 172 which can be connected to a device with a speaker. In one embodiment, the second connection cable 174 does not retract. In another embodiment, the second connection cable can retract. In this embodiment, the retractable cable module can be a dual retraction unit.

Figure 10A:
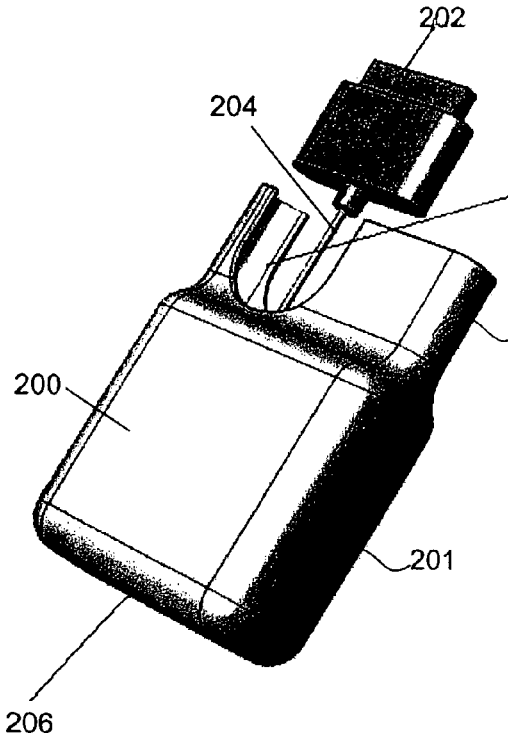
FIGS. 10A-10D illustrate a removable module of one embodiment.
Figure 10B:
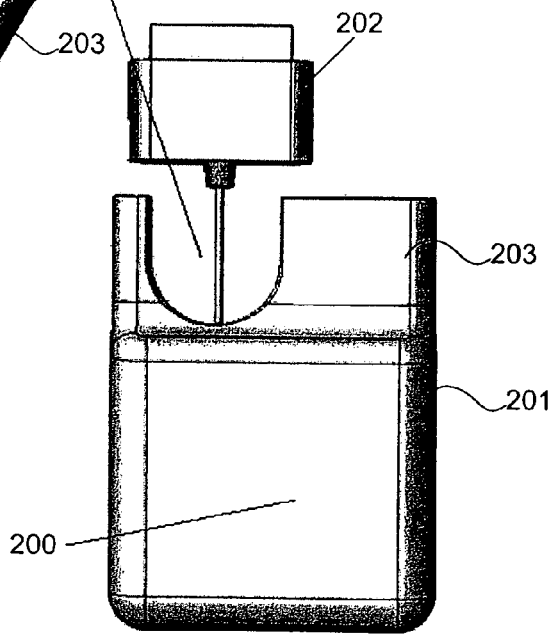
Figure 10C:
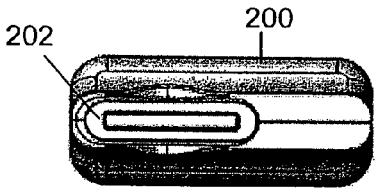

FIGS. 10A-C shows a cable module 200 with a connector 202 attached to a cable 204. The cable 204 can be wound about a spool and kept under tension as discussed above. A connector 206 at the bottom of the module 200 can allow for the connection of the module 200 to another device, such as a chair device, a media player, or stereo speakers. The module 200 can have a removal slot 208 to allow the connector to be grasped by a user. A digital or analog media signal, such as a music signal, can be sent from the portable media unit through the connector to the device. In this embodiment the cable 204 is retractable. In an alternative embodiment the cable 204 can be non-retractable and of a fixed length.

In one embodiment, the connector 202 can also be adapted to provide power to the portable media unit. The 32-pin connector used with the iPod® is an example of a connector that can be used for both a power transfer to the portable media unit and to obtain an audio signal from the portable media unit. The 32-pin connector of the iPod® includes left/right analog audio input, left/right analog audio output, USB connection pins, Firewire connection pins, a device id pin and a power pin. The relevant pins can be electrically connected through the connector 206 of the module to the device.

The module can have an interface with other types of portable media players to allow power to be input and audio or video or other signals to be output. Other modules, such as CD, tape or DVD player modules, radio modules and the like, can be substituted for the module with an appropriate portable media unit connector. Such connectors can include an iPod® connector as described above, an iPod® Shuffle connector, a thick wired iPod® connector that allows remote control use of the portable media unit and that can charge the portable media unit, or the like.

Figure 10D:
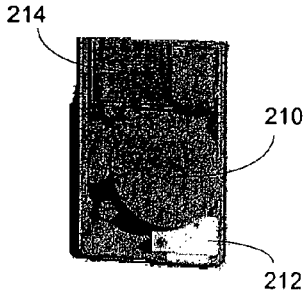

FIG. 10D shows a cross-sectional view of a module showing a tensioning spool 210 connected to a module connector 212 to create the retractable cable module. The tensioning spool can be used for winding out the 32-pin connector 214.

Figure 11:
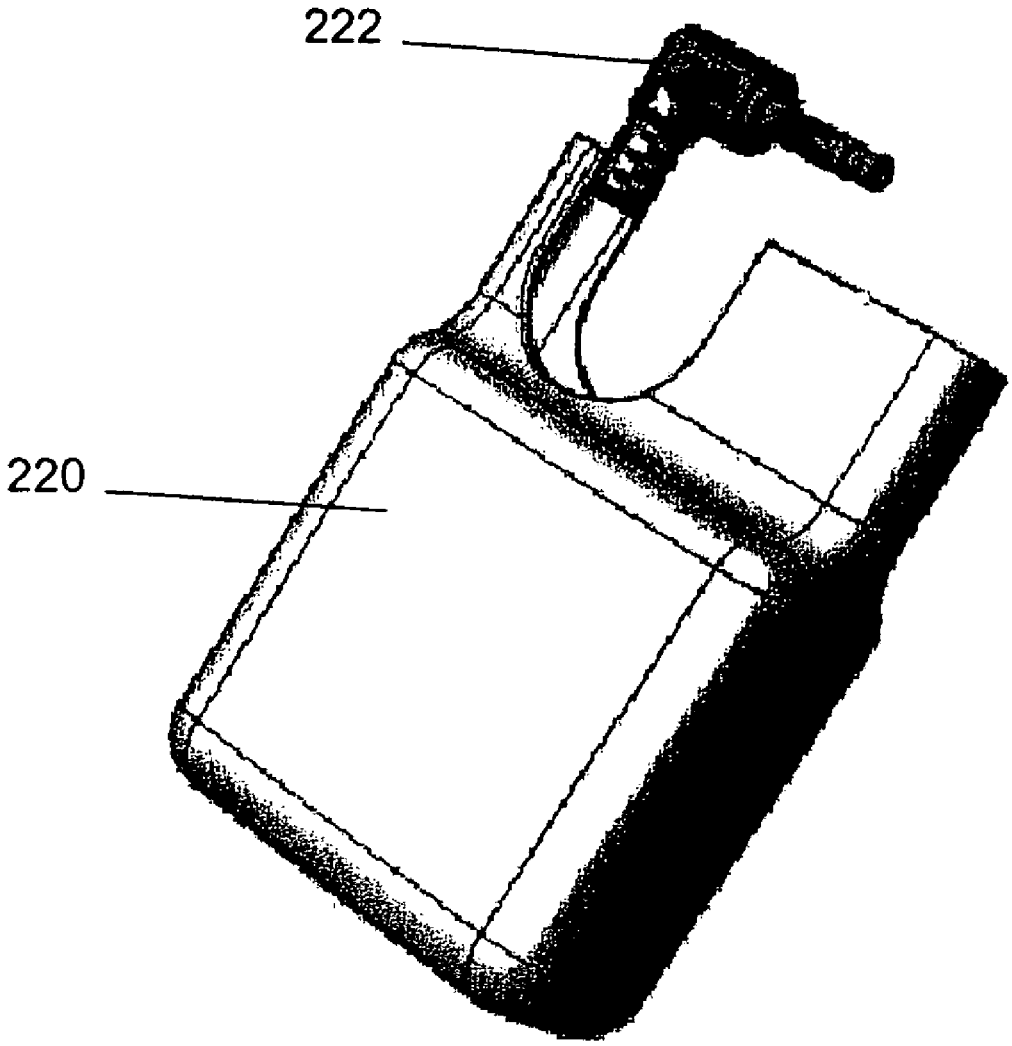
FIG. 11 illustrates a removable module of an alternate embodiment.

FIG. 11 shows a module 220 with a jack connector 222. The module 220 with the jack connector 222 can replace the module 200 in the device with a speaker. The jack connector 222 can transfer a stereo audio signal. Although FIG. 11 illustrates a module with a retractable cable, it should be understood that the cable can alternatively be non-retractable and of a fixed length.

Figure 12A:
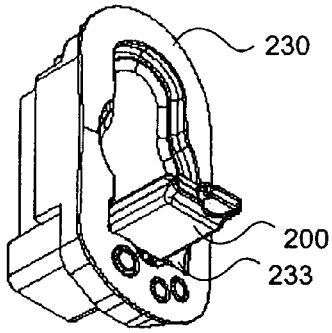
FIGS. 12A-12D illustrate one embodiment of a holder for a removable module.
Figure 12B:
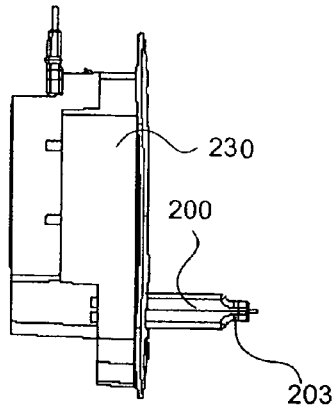
Figure 12C:
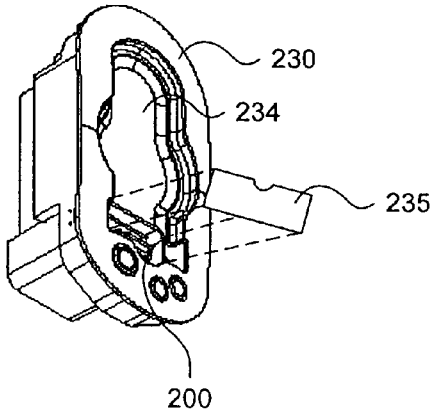

FIGS. 12A and 12B illustrates a holder 230 which can receive an interchangeable cable module 200. FIG. 12C shows that the module 200 can be positioned within the holder 230. The module 200 can be received in a recess 233 of the holder 230. The recess 233 in this embodiment is rectangular to accommodate the shape of the module 200. It should be understood that the shape of the module and the shape of the recess is not limited to rectangular, but can be any shape so long as the recess is shaped to receive the module. The module 200 can be placed in and removed from the recess 233 by the user gripping the edge 203 of the module. Alternately, the recess 233 can be provided with a spring loaded device for receiving and ejecting the module 200. As is known in the art, the module 200 can be inserted into the recess 233 with the spring loaded device. Subsequent pushing down on the module 200 can cause a spring of the spring loaded device to urge the module 200 upward and out of the recess 233 of the holder 230.

The holder 230 can be part of a chair or other piece of furniture or equipment such as a speaker system. The holder 230 can include another recess 234 for receiving a personal media unit. This additional recess 234 can include a site for finger access 237 that allows a user to grip the personal media unit when it is being inserted into or pulled out of the recess 234.

Figure 12D:
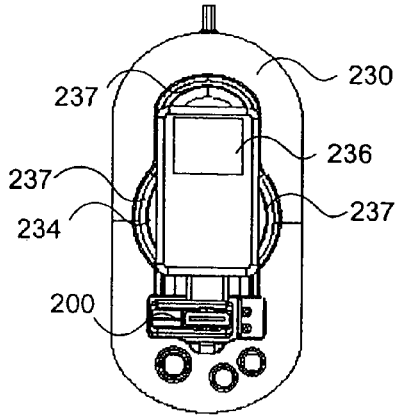

FIG. 12D illustrates a personal media unit 236 positioned within the recess 234 of the holder 230. The personal media unit can be connected to the cable module 200 using the connector such as those described in relation to FIGS. 10A-D and 11. A protective cover 235 such as shown in FIG. 12C can be selectively placed over the outside of the top portion of the module and affixed to the holder 230. The protective cover 235 can be a flat element with a finger access region for removal. Alternately, the protective cover can be a flat element with a center hole for surrounding the top portion of the module.

Figure 13:
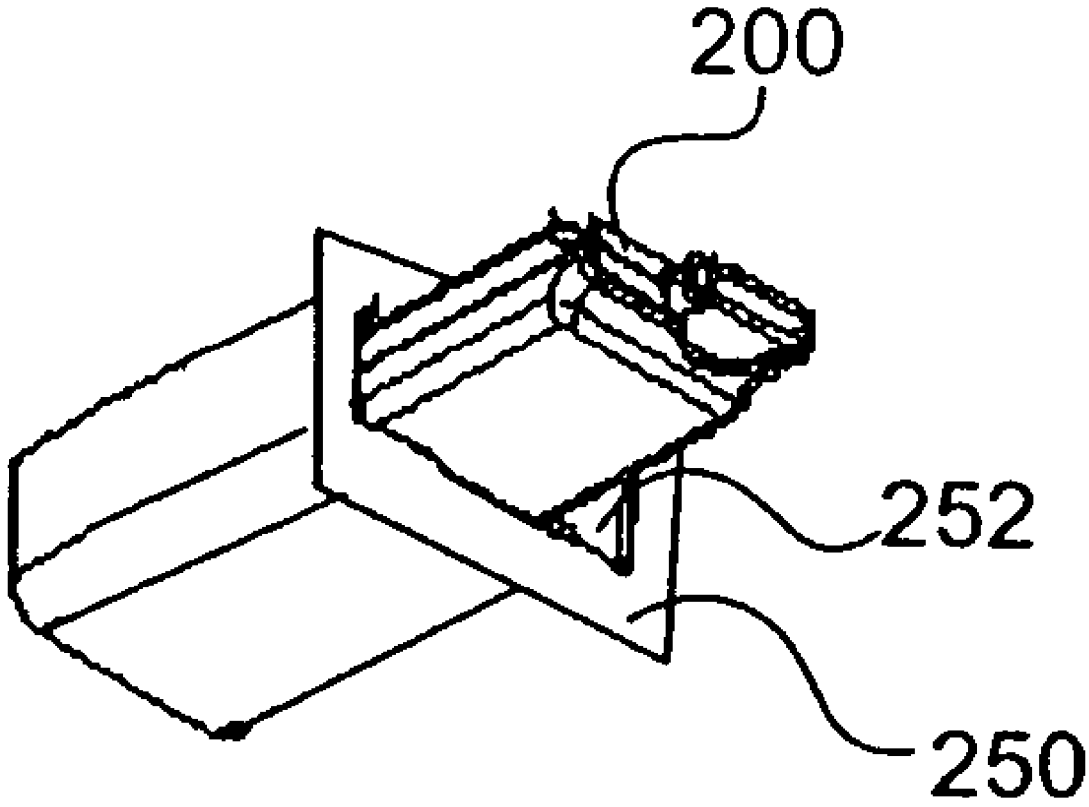
FIG. 13 illustrates an alternate embodiment of a holder for a removable module.

FIG. 13 shows an alternate embodiment of a holder 250 without a region to hold a personal media unit. This holder 250 has a recess 252 that can operate similar to recess 233 of FIG. 12A.

Looking at FIGS. 10A-10D, one embodiment of the present invention is a module 200 comprising a housing 201; a retractable cable 204 located in the housing 201; a portable media player connector 202 mounted on the end of the retractable cable; and a port located on a sidewall of the housing. The connector 202 can have a received position relative to the port when the cable is retracted in the housing. In an alternative embodiment, the cable can be non-retractable and of a fixed length. In either case, the connector 202 can be accessible at the top of the housing. The connector 202 can be located adjacent to the sidewall and the port and adapted such that a user may reach through the port in the side wall in order to pull the connector out of the housing 201.

The housing 201 can have a main body and a neck extending from the main body. The sidewall can be provided in the neck. A port can be provided in the neck. Another port can provide through the neck and be at least partially aligned with the port to allow a user to access the connector 202 through the port and the another port. The two ports can form the access area 208.

In one embodiment, the housing 201 can include a rectangular main body and a rectangular neck extending from the main body. The neck can be thinner than the main body.

In yet another embodiment, another connector 206 can be provided in the housing 201. The another connector 206 can communicate with the cable 204 whether retractable or non-retractable. The other connector 206 can be affixed to the housing. The another connector 206 can be provided on a portion of the housing that is opposite to the neck.

One embodiment of the present invention is a module 200 comprising a housing 201 with a top and a bottom, a retractable cable 204 located in the housing, and a portable media player connector 202 mounted on the end of the retractable cable. The connector 202 can be accessible at the top of the housing. Another connector 206 can be accessible at the bottom of the housing. In one embodiment, the another connector 206 is affixed to the bottom of the housing.

One embodiment of the present invention is a device adapted for receiving a portable media player. The device can comprise a first compartment 234 adapted to receive a portable media player 236 and a second compartment 233 adapted to receive an interchangeable cable module 200 that contains a connector 202 that can connect to the portable media player 236. The second compartment 233 can include a connector adapted to connect to the interchangeable cable module.

The second compartment 233 can be provided at about 90 degrees from the first compartment. The first compartment 234 can be horizontal and the second compartment 233 vertical. The first compartment 234 can be shallow and the second compartment 233 deep.

The second compartment 233 can include an ejection mechanism that is adapted to eject a cable module 200 positioned in the second compartment 233. The connector can be located at the bottom of the second compartment 233. A cover 235 can enclose the second compartment 233.

The first compartment 234 can include at least one finger recess 237 adapted to accept at least one finger of a user to aid in removing a portable media player 236 from the first compartment 234. The second compartment 233 can include at least one finger recess adapted to accept at least one finger of a user to aid in removing an interchangeable cable module from the second compartment.

The foregoing description of preferred embodiments of the present invention has been provided for the purposes of illustration and description. It is not intended to be exhaustive or to limit the invention to the precise forms disclosed. Many embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalents.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A cable module assembly comprising:

a first housing having sidewalls and a recess located on a sidewall, including a cable having a media connectors, the media connector having a received position adjacent to the recess, and the recess being configured such that a user may reach through the recess and pull the media connector from the recess;

another connector affixed to the first housing; and a second housing having:

(a) a top and a bottom;

(b) a recess adapted to receive the first housing;

(c) a housing connector within the recess of the second housing for making a connection between the first and second housing; and (d) wherein the housing connector connects with the another connector affixed to said first housing.

2. The cable module assembly of claim 1 wherein:

the first housing has a main body and a neck extending from the main body and the sidewall is provided in the neck.

3. The cable module assembly of claim 2, wherein the first housing defines another recess within the neck.

4. The cable module assembly of claim 2, wherein the neck is thinner than the main body.

5. The cable module assembly of claim 1, wherein said another connector is configured to communicate with the cable.

6. The cable module assembly of claim 2, wherein the another connector is positioned opposite of the neck.

7. The cable module assembly of claim 1, which includes a retraction device operable to retract the cable.

8. A system comprising:

a sound generator having:

(a) a sound generator housing defining a first interior space;

(b) an audio input port supported by the sound generator housing;

(c) a support supported by the sound generator housing, the support configured to hold a portable media player, the portable media player configured to be operable independent of the sound generator when the portable media player is electronically disconnected from the sound generator, the portable media player having an audio output port;

(d) at least one speaker supported by the sound generator housing; and the cable module having:

(a) a cable module housing having a first end, a second end, and a body extending between the first and second ends, the body defining a second interior space, the cable module housing being configured so that the body is insertable into the first interior space;

(b) a retract device positioned at least partially within the second interior space of the cable module housing; and (c) a cable coupled to the retract device, the cable having:

(i) a first connector configured to be connected to the audio input port of the sound generator;

(ii) a second connector configured to be connected to the audio output port of the portable media player, the second connector being movable between: (1) a retracted position in which the second connector is positioned adjacent to the second end of the cable module housing when the body of the cable module housing is inserted into the first interior space; and (2) an extended position.

9. The system of claim 8, wherein the cable module is removable.

10. The system of claim 8, wherein the second connector comprises a stereo jack plug or a multipin connector.

11. The system of claim 10, wherein the second connector includes a power pin.

12. The system of claim 8, wherein the cable of the cable module is a single cable.

13. The system of claim 8, wherein the second end of the cable module housing is positioned adjacent to a wall of the sound generator housing when the body of the cable module housing is inserted into the first interior space.

14. A cable module comprising:

a cable module housing usable with a sound generator, the sound generator having: (a) a sound generator housing which defines a first interior space; (b) an audio input port; and (c) at least one speaker, the cable module housing having a first end, a second end, and a body extending between the first and second ends, the body defining a second interior space, the cable module housing being configured so that the body is insertable into the first interior space;

a retract device positioned at least partially within the second interior space of the cable module housing; and a cable coupled to the retract device, the cable having:

(a) a first connector configured to be connected to the audio input port of the sound generator; and (b) a second connector configured to be connected to an audio output port of a portable media player, the portable media player configured to be operable independent of the sound generator when the portable media player is electronically disconnected from the sound generator, the second connector being movable between:

(i) a retracted position in which the second connector is positioned adjacent to the second end of the cable module housing when the body of the cable module housing is inserted into the first interior space; and (ii) an extended position.

15. The cable module of claim 14, wherein the sound generator housing has a main body and a neck extending from the main body.

16. The cable module of claim 15, wherein the neck defines the first interior space.

17. The cable module of claim 15, wherein the neck is thinner than the main body.

18. The cable module of claim 14, wherein the cable is a single cable.

19. The cable module of claim 14, wherein the first connector is affixed to the cable module housing.

20. The cable module of claim 14, wherein the retract device is configured to be fully positioned within the second interior space of the cable module.

21. The cable module of claim 14, wherein the audio input port of the sound generator housing is affixed to the sound generator housing.

22. The cable module of claim 14, wherein the cable module housing is configured to be fully insertable into the first interior space.

* * * * *